United States Patent [19]

Carretta

[11] Patent Number: 5,069,599

[45] Date of Patent: Dec. 3, 1991

[54] METAL PLATE STATOR CASE, PARTICULARLY FOR RADIAL CENTRIFUGAL PUMPS

[75] Inventor: Tiziano Carretta, Grumolo Delle Abbadesse, Italy

[73] Assignee: Ebara Corporation, Tokyo, Japan

[21] Appl. No.: 558,585

[22] Filed: Jul. 26, 1990

[30] Foreign Application Priority Data

Aug. 18, 1989 [IT] Italy ..... 85635 A/89

[51] Int. Cl.[5] ..... F01D 1/00; F01D 9/00; F03B 1/00; F04D 1/00

[52] U.S. Cl. ..... 415/182.1; 415/203; 415/204; 415/206; 415/207; 416/DIG. 3

[58] Field of Search ..... 415/182.1, 203, 204, 415/206, 207; 416/DIG. 3

[56] References Cited

U.S. PATENT DOCUMENTS

| | | | |
|---|---|---|---|
| 340,120 | 4/1886 | Hussey | 415/203 |
| 3,846,040 | 11/1974 | Dennis | 415/206 |
| 3,856,431 | 12/1974 | Tucker | 415/207 |
| 4,392,779 | 7/1983 | Bloemers et al. | 415/182.1 |
| 4,494,908 | 1/1985 | Hopfensperger | 415/204 |

FOREIGN PATENT DOCUMENTS

| | | | |
|---|---|---|---|
| 1141182 | 8/1957 | France | 415/203 |
| 125328 | 1/1961 | France | 415/203 |
| 0020252 | 2/1979 | Japan | 415/204 |
| 0125318 | 9/1979 | Japan | 415/182 |
| 0941692 | 7/1982 | U.S.S.R. | 415/182.1 |

*Primary Examiner*—Edward K. Look
*Assistant Examiner*—Thomas Denion
*Attorney, Agent, or Firm*—Wolf, Greenfield & Sacks

[57] ABSTRACT

The metal plate stator case (1), for radial centrifugal pumps, includes a main body (2), a diffusion volute (10), an axial suction inlet (3) and a radial discharge outlet (4) at the output of the diffusion volute. The volute is constituted by a circumferential channel (11) which is defined in the lateral wall of the main body and has a radial transverse cross section which increases uniformly toward the output of the volute. At least one portion of the channel has, in transverse cross section, a substantially constant radial depth and a uniformly increasing axial width.

11 Claims, 3 Drawing Sheets

METAL PLATE STATOR CASE, PARTICULARLY FOR RADIAL CENTRIFUGAL PUMPS

BACKGROUND OF THE INVENTION

1. Field of the Invention

The present invention relates to a metal plate stator case for radial centrifugal pumps.

2. Description of the Prior Art

Stator cases of this type are known in which an annular header is provided peripherally to the bladed impeller; said header is formed by a circular channel which has an approximately constant radial transverse cross section and has the function of collecting and conveying the output flow from the impeller toward an essentially radial discharge outlet. Since a diffusion element for converting part of the kinetic energy imparted to the fluid by the impeller into pressure energy is not provided inside said cases for the sake of constructive simplicity, the discharge outlet itself is shaped like a diffusion nozzle. For this purpose, the discharge outlet is constituted by a divergent duct which is designed so as to allow an adequate loss of speed and a corresponding increase in pressure.

Though on one hand it offers the advantage of considerable constructive simplicity, this solution on the other hand has some structural disadvantages which are observed during the operation of the pump. The flow collected by the annular header along its circumferential extension in fact increases progressively from a minimum value to a maximum one toward the discharge outlet and then suddenly drops back to the initial minimum value after said discharge outlet. The impeller is consequently subjected to considerable periodic stresses which are equal in frequency to the rotation rate of the pump; these stresses cause early breakage due to fatigue and produce considerable noise. Stator cases of this type are furthermore characterized by a excessive size due to the considerable length of the diffusion and discharge nozzle.

In order to obviate the above described disadvantages, it has been proposed to make metal plate stator cases provided with a spiral-shaped volute similar in design to monolithic stator cases obtained by casting. However, the manufacturing of these types of volute is still rather expensive due to the large number of component parts or to the use of complicated and expensive pressing methods.

The aim of the present invention is to eliminate or at least significantly reduce the disadvantages described above by providing a metal plate stator case, particularly for centrifugal radial pumps, which is highly reliable and has a reduced cost.

Within the scope of the above described aim, a particular object of the present invention is to provide a metal plate stator case which has a diffusion volute which is functionally equivalent to those obtained by casting.

Not least object of the invention is to provide a metal plate stator case which can be easily obtained by pressing starting from commonly commercially available materials.

SUMMARY OF THE INVENTION

This aim, these objects and others which will become apparent hereinafter are achieved by a metal plate stator case, particularly for radial centrifugal pumps, comprising a main body, which defines a lateral wall and a front wall, a diffusion volute, an axial suction inlet and a radial discharge outlet at the output of said diffusion volute, said volute being constituted by a circumferential channel which is defined in the lateral wall of said main body and has a radial transverse cross section which rises uniformly toward the output of said volute, at least one portion of said channel having, in said transverse cross section, a substantially constant radial depth and an axial width which increases uniformly toward the output of said volute.

BRIEF DESCRIPTION OF THE DRAWINGS

Further characteristics and advantages will become apparent from the description of some preferred but not exclusive embodiments of a metal plate stator case, illustrated only by way of non-limitative example in the accompanying drawings, wherein.

DESCRIPTION OF THE PREFERRED EMBODIMENTS OF THE INVENTION

Figure 1:
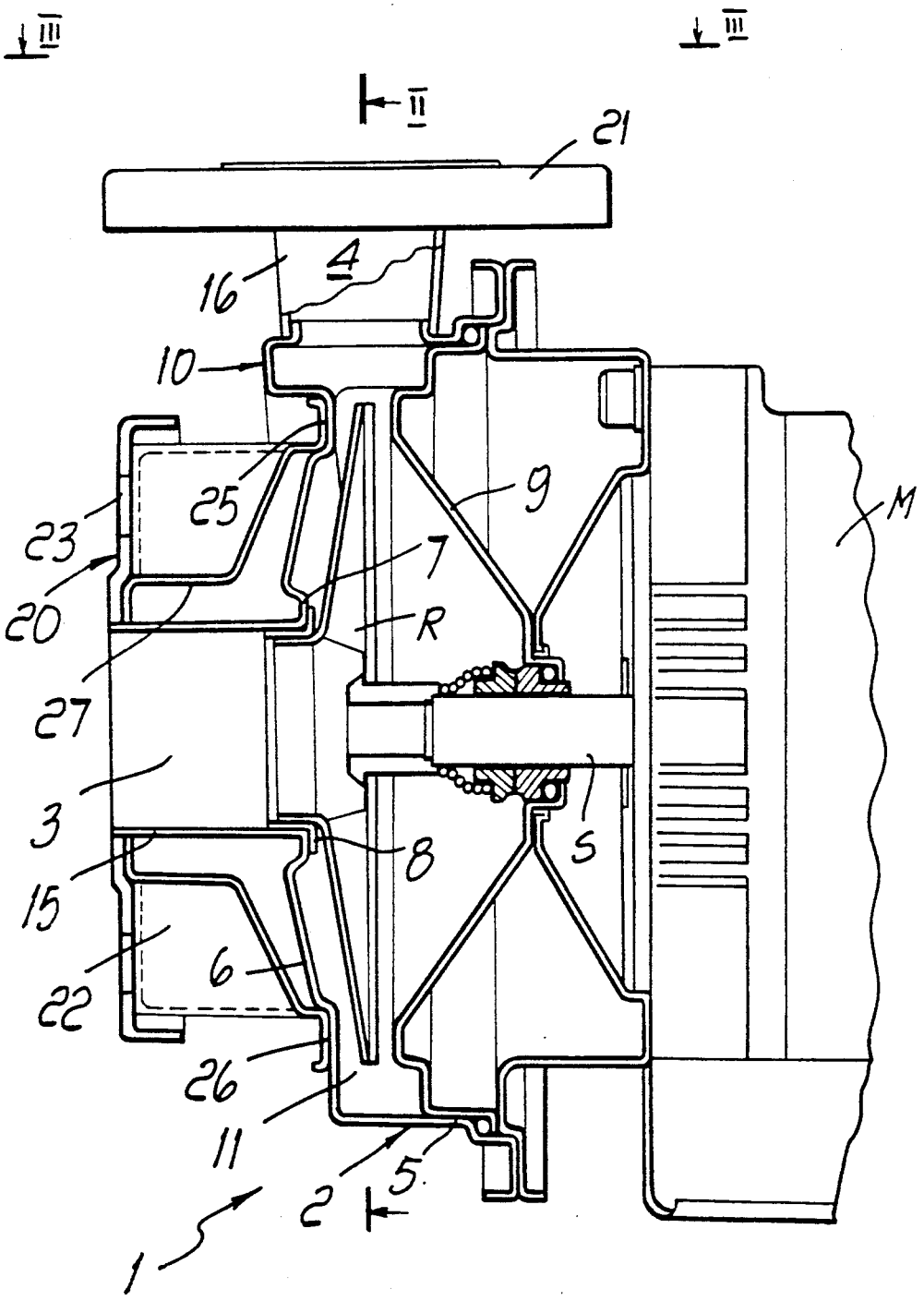
FIG. 1 is a partially sectional side view, according to an axial vertical plane, of a centrifugal pump with metal plate stator case according to the invention in a first embodiment.

With reference to the above figures, the stator case according to the invention, generally indicated by the reference numeral 1, comprises a main body 2 which has a substantially axial suction inlet 3 and an approximately radial discharge outlet 4. The main body 2, made of stamped plate, defines a substantially cylindrical side wall 5 and a front wall 6 which supports, in its central portion 7, an insert sealing ring or shim 8 which has for example an L-shaped or U-shaped cross section. The main body 2 is rigidly and sealingly connected to a separator flange 9 which is arranged opposite to the suction inlet and has a central sealing ring W adapted to cooperate with the shaft S of the motor M. The main body 2 and the separator flange 9 therefore delimit, with the respective sealing and shim rings, a pressure chamber which accommodates the impeller R.

A volute 10 is defined on the lateral wall 5 of the main body 2 made of metal plate and is constituted by an annular recess or channel 11 which extends peripherally to the impeller R. The radial transverse cross section of the annular channel 11 rises toward the output of the volute 10, so as to determine, in a per se known manner, the collection and gradual diffusion of the fluid at the output of the impeller.

Figure 2:
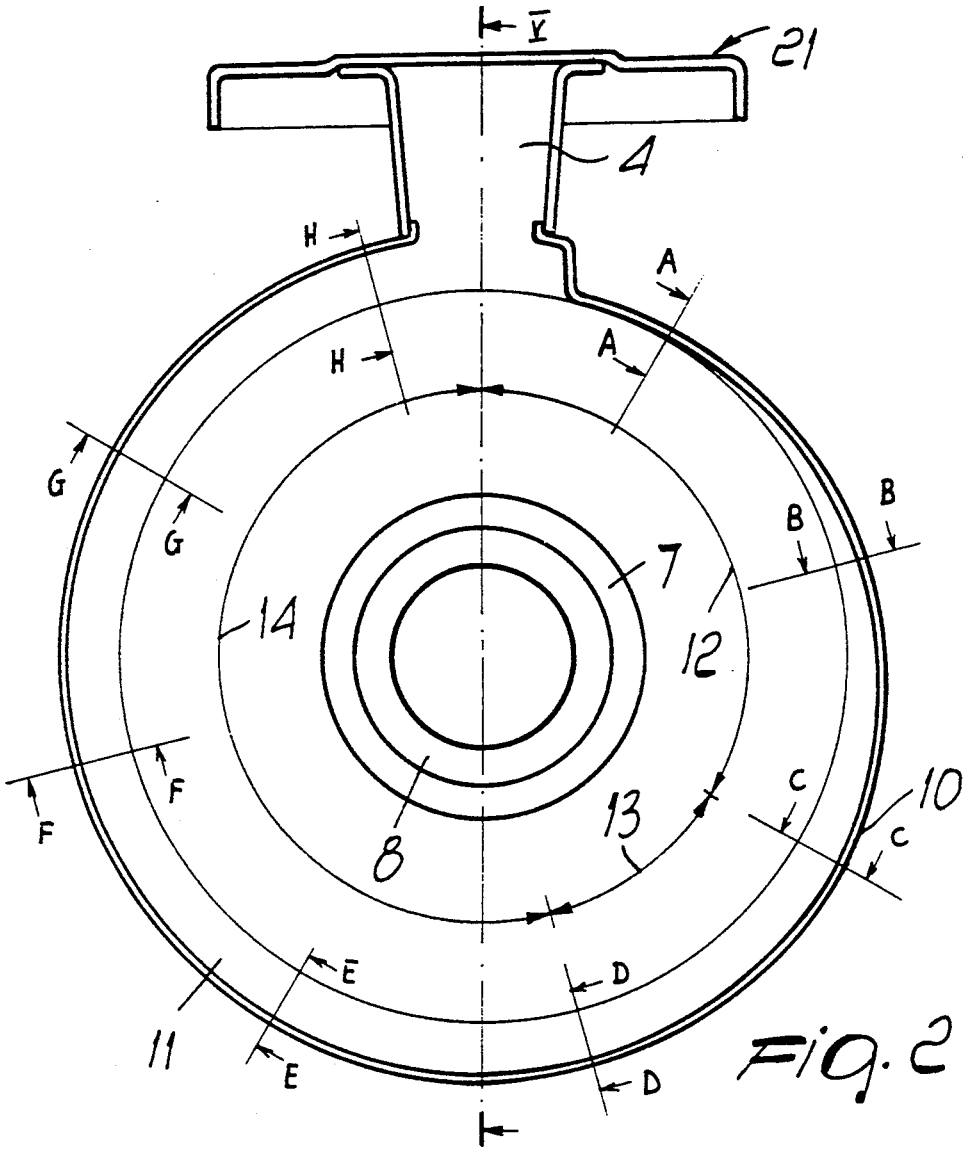
FIG. 2 is a sectional view, taken along the plane II—II, of the stator case of FIG. 1.
Figure 3:
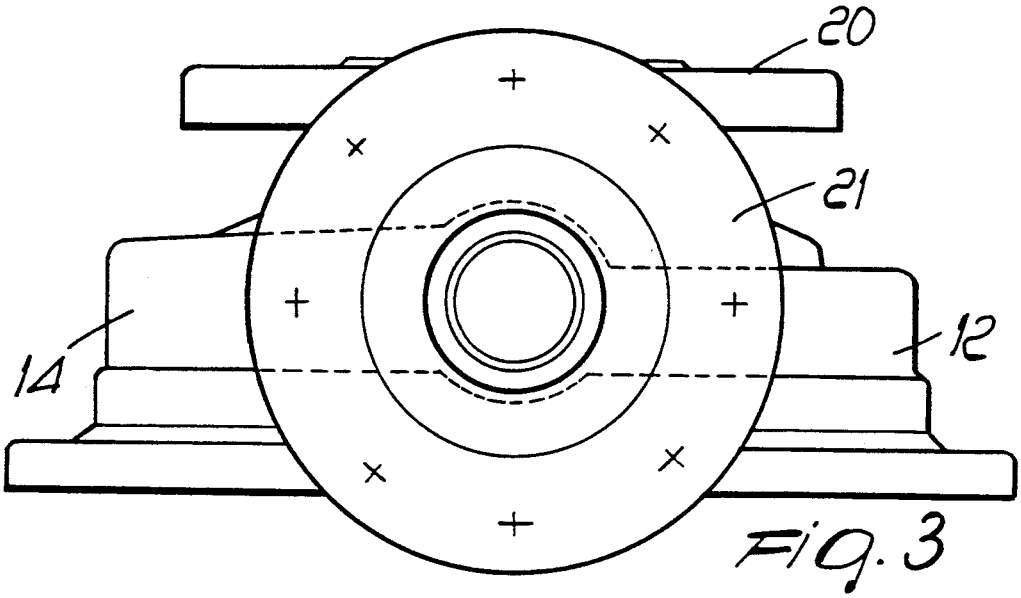
FIG. 3 is a side view of the stator case of FIG. 1, taken from the side of the discharge outlet, along the direction of the arrow III.
Figure 4:
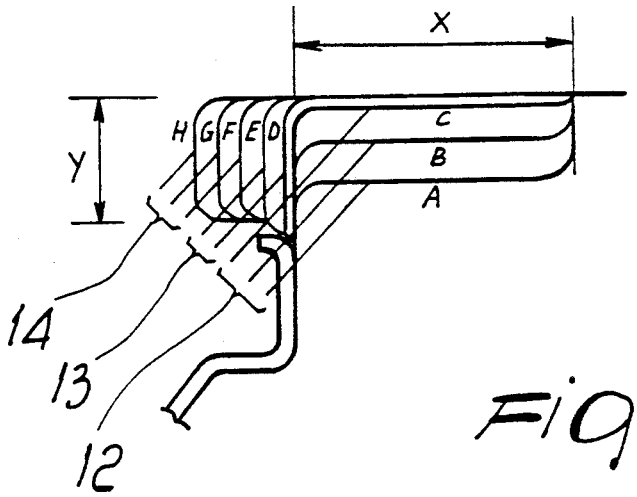
FIG. 4 is a schematic diagram of some radial transverse cross sections of the diffusion volute along its circumferential extension.

At least one portion of the annular recess 11 has a radial transverse cross section which has a substantially constant radial depth and has an axial width which rises uniformly toward the output of the volute. In FIG. 2, the letters A, B, C, D, E, F, G, H indicate radial cross sections of the annular channel 11 which defines the volute 10. The outer profiles of said radial transverse cross sections are illustrated in FIG. 4. From these figures it can be easily understood that in the final portion 12 comprised between the radial cross section D—D and the discharge outlet 4 the annular channel 11 has a radial depth y which is substantially constant and an axial width x which increases toward the discharge outlet, for example with a linear law. Exactly the reverse occurs in the final portion 14 of the annular channel 11, i.e. the radial depth y rises toward the output of the volute whereas the axial width x is substantially constant.

An intermediate portion 13 is defined between the end portions 12, 14, and in said portion the radial dimension y and the axial dimension x both increase gradually and in a linear manner. The three subsequent portions 11, 12 and 13 are obviously adequately mutually blended so as to avoid flow discontinuity. It is evident that the order of the initial and final portions may be reversed without abandoning the scope of the invention.

Figure 5:
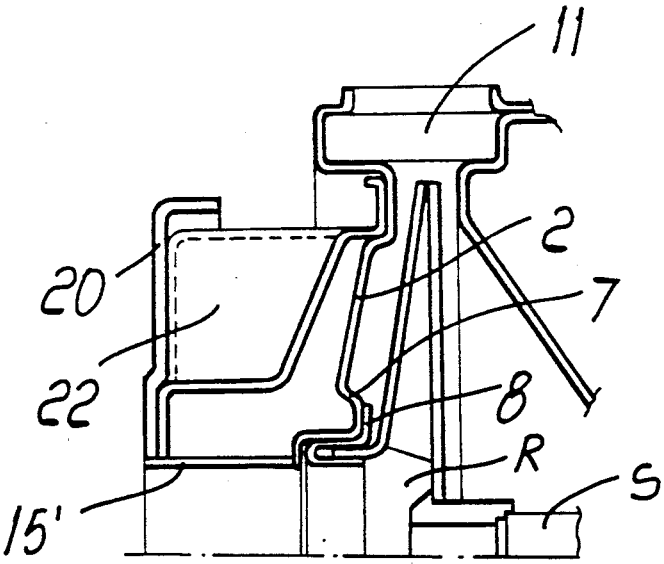
FIG. 5 is a sectional view of a detail of the stator case, according to the line V—V of FIG. 2, in a second embodiment.

In a second aspect, the suction inlet 3 and the discharge outlet 4 are constituted by respective ducts 15, 16 which are made of metal plate, preferably of the same metallic material as the main body 2. In the embodiment of FIG. 1, the channel 15 is shown monolithically integral with the main body 2, whereas in FIG. 5 it is constituted by a sleeve 15' which is welded at 17 to the front wall 6 of the main body 2. In both embodiments, the discharge outlet 16 can be welded at 18 to the outlet of the volute 10. Connecting flanges 20, 21, respectively welded to the ends of the ducts 15, 15', 16, are provided.

Advantageously, the suction inlet 3, and optionally the discharge outlet 4, may have a stiffening structure constituted by a plurality of hollow metal plate ribs suitable for connecting the main body 2 to the respective end flanges. By way of example, said stiffening structure has been illustrated in FIG. 1 only for the suction inlet 3. In said structure, the ribs 22, which are interposed between the holes 23 of the flange 20, are connected by means of the annular portion 25 to the main body 2 at the welding points 26 and to the flange 20 at the welding points 24. For the sake of constructive simplicity, the ribs 22 can be made monolithically of stamped plate, so as to be mutually connected with continuity by the central wall 27. For the sake of completeness in description, the radial transverse cross section of the annular channel 11 has been shown with a substantially rectangular shape; however, different shapes, such as for example a semi-elliptical one, may be equally used without abandoning the scope of the invention. The materials used for the various parts may be stainless steels or other metallic and synthetic materials, preferably corrosion-resistant ones.

From what has been described above it can be understood that the invention achieves the intended aim and objects, in particular that of providing a stator case with a diffusion volute which is structurally simple and easy to obtain by means of normal pressing methods. The case, according to the invention, is susceptible to numerous modifications and variations which are within the scope of the inventive concept defined in the accompanying claims.

I claim:

1. Metal plate stator case, particularly for radial centrifugal pumps, comprising a main body, which defines a lateral wall and a front wall, a diffusion volute, an axial suction inlet and a radial discharge outlet at the output of said diffusion volute, said volute being constituted by a circumferential channel which is defined in the lateral wall of said main body and has a radial transverse cross section which rises uniformly toward the output of said volute, at least one portion of said channel having, in said transverse cross section, a substantially constant radial depth and an axial width which increases uniformly toward the output of said volute.

2. Stator case, according to claim 1, wherein said portion with constant radial depth and uniformly rising axial width is a final portion of said volute.

3. Stator case, according to claim 2, wherein said channel comprises an initial portion which has, in transverse cross section, a substantially constant axial width and a radial depth which increases uniformly toward the outlet of said volute.

4. Stator case, according to claim 3, wherein said channel comprises, between said initial portion and said final portion, an intermediate portion which has a radial depth and an axial width which increase uniformly toward the output of said impeller.

5. Stator case, according to claim 3, wherein said channel comprises, between said initial portion and said final portion, an intermediate portion which has a radial depth and an axial width which increase uniformly toward the output of said volute, said initial, intermediate and final portions of said channel being mutually blended with continuity.

6. Stator case, according to claim 1, said suction inlet and said discharge outlet both comprise a duct which has a respective connecting flange at its end.

7. Stator case, according to claim 1, wherein a central portion of said front wall of said main body has a surface for connection to a shim ring.

8. Stator case, according to claim 7, wherein said connecting surface has a step-like shape so as to define a seat for the shim ring.

9. Stator case, according to claim 6, wherein a stiffening structure is provided peripherally to at least one of said suction and discharge ducts, said stiffening structure comprising a plurality of box-like ribs made of metal plate, each of which is connected to said main body on one side and to the respective connecting flange on the other side.

10. Stator case, according to claim 6, wherein a stiffening structure is provided peripherally to at least one of said suction and discharge ducts, said stiffening structure comprising a plurality of box-like ribs made of metal plate, each of which is connected to said main body on one side and to the respective connecting flange on the other side ribs being interposed between coupling holes of the respective connecting flange, said ribs being provided monolithically and being joined in adjacent central portions.

11. Stator case, according to claim 1, wherein said radial transverse cross section of said channel has an approximately rectangular shape.

* * * * *